US012004692B2

(12) United States Patent
Oeguen et al.

(10) Patent No.: US 12,004,692 B2
(45) Date of Patent: Jun. 11, 2024

(54) SHEET PRODUCT DISPENSER AND PACKAGING UNIT THEREFOR

(71) Applicant: CARL FREUDENBERG KG, Weinheim (DE)

(72) Inventors: Handan Oeguen, Heidelberg (DE); Felix Fallenstein, Speyer (DE); Andreas Eisenhut, Pullach (DE); Benno Dariz, Brixen (IT); Sebastian Camerer, Berlin (DE)

(73) Assignee: CARL FREUDENBERG KG, Weinheim (DE)

( * ) Notice: Subject to any disclaimer, the term of this patent is extended or adjusted under 35 U.S.C. 154(b) by 330 days.

(21) Appl. No.: 17/598,307

(22) PCT Filed: Mar. 13, 2020

(86) PCT No.: PCT/EP2020/056894
§ 371 (c)(1),
(2) Date: Sep. 27, 2021

(87) PCT Pub. No.: WO2020/193232
PCT Pub. Date: Oct. 1, 2020

(65) Prior Publication Data

US 2022/0160189 A1 May 26, 2022

(30) Foreign Application Priority Data

Mar. 28, 2019 (EP) ..... 19165824

(51) Int. Cl.
*A47K 10/38* (2006.01)
*A47K 10/32* (2006.01)

(52) U.S. Cl.
CPC .. *A47K 10/3818* (2013.01); *A47K 2010/3233* (2013.01); *A47K 2010/3266* (2013.01)

(58) Field of Classification Search
CPC .... A47K 2010/3233; A47K 2010/3266; A47K 1/00; A47K 1/02; A47K 1/09;
(Continued)

(56) References Cited

U.S. PATENT DOCUMENTS 2,068,444 A * 1/1937 Breckenridge ..... B65D 51/243 215/257
4,535,912 A 8/1985 Bonk
(Continued)

FOREIGN PATENT DOCUMENTS

CN 201414667 Y 3/2010
CN 203889426 U 10/2014
(Continued)

*Primary Examiner* — Anthony D Stashick
*Assistant Examiner* — Marcos Javier Rodriguez Molina
(74) *Attorney, Agent, or Firm* — LEYDIG, VOIT & MAYER, LTD.

(57) ABSTRACT

A sheet product dispenser is provided that includes a housing and a packaging unit arranged in the housing. The packaging unit includes a roll of sheet products and a liquid-tight bag in which the roll is arranged. The liquid-tight bag includes a removal opening for removal of the sheet products, the removal opening being delimited by a dimensionally stable coupling ring made of a tough material. The dimensionally stable coupling ring is connected to an annular feeder encompassing a feeder opening, and the housing and the annular feeder are non-destructively and releasably connected to one another.

28 Claims, 4 Drawing Sheets

(58) Field of Classification Search

CPC ..... A47K 10/00; A47K 10/02; A47K 10/16; A47K 10/18; A47K 10/185; A47K 10/20; A47K 10/22; A47K 10/24; A47K 10/26; A47K 10/28; A47K 10/30; A47K 10/32; A47K 10/34; A47K 10/36; A47K 10/3606; A47K 10/3612; A47K 10/3618; A47K 10/3625; A47K 10/3631; A47K 10/3637; A47K 10/3643; A47K 10/3656; A47K 10/3662; A47K 10/3687; A47K 10/38; A47K 10/3809; A47K 10/3818; A47K 10/3827; A47K 10/3836; A47K 10/3845; A47K 10/40; A47K 10/405; A47K 10/42; A47K 10/421; A47K 10/422; A47K 10/423; A47K 10/424; A47K 10/425; A47K 10/426; A47K 10/427; A47K 10/44; A47K 10/46; A47K 11/02; A47K 11/04; A47K 11/06; A47K 11/10; A47K 11/105; A47K 13/02; A47K 13/06; A47K 13/14; A47K 13/16; A47K 13/165; A47K 13/24; A47K 13/245; A47K 17/00; A47K 17/003; A47K 17/02; A47K 17/028; A47K 2005/1218; A47K 2010/3206; A47K 2010/322; A47K 2010/324; A47K 2010/3246; A47K 2010/3253; A47K 2010/326; A47K 2010/3273; A47K 2010/328; A47K 2010/3286; A47K 2010/3293; A47K 2010/365; A47K 2010/3668; A47K 2010/3675; A47K 2010/3681; A47K 2010/3693; A47K 2010/3854; A47K 2010/3863; A47K 2010/3872; A47K 2010/3881; A47K 2010/389; A47K 2010/428; A47K 2201/00; A47K 2201/02; A47K 2201/025; A47K 2210/00; A47K 3/281; A47K 3/286; A47K 3/34; A47K 4/00; A47K 5/06; A47K 5/12; A47K 5/1201; A47K 5/1202; A47K 5/1204; A47K 5/1205; A47K 5/1207; A47K 5/1211; A47K 5/1212; A47K 5/1217; A47K 5/14; A47K 5/18; A47K 7/00; A47K 7/02; A47K 7/022; A47K 7/03; A47K 7/08

USPC ..... 53/53, 51, 55, 72, 74, 76, 128.1, 129.1, 53/133.1, 133.3, 134.2, 135.3, 155, 156, 53/157, 209, 211, 214, 216, 228, 229, 53/237, 266.1, 281, 282, 284.4, 296, 307, 53/319, 329.2, 329.4, 329.5, 373.4, 374.6, 53/376.2, 377.2, 381.3, 382.1, 384.1, 53/389.1, 389.5, 391, 396, 397, 399, 410, 53/411, 412, 413, 415, 420, 430, 432, 53/434, 441, 447, 450, 452, 453, 455, 53/456, 461, 465, 466, 467, 469, 471, 53/476, 478, 484, 485, 486, 487, 489, 53/490, 492, 493, 497, 510, 512, 520, 53/532, 540, 543, 544, 550, 551, 553, 53/556, 557, 558, 559, 562, 570, 580, 53/590, 111 R; 112/475.01; 128/200.14, 128/200.23, 203.12, 203.15, 203.21, 128/204.23, 851, 853, 854, 856, 898; 206/0.5, 0.83, 1.5, 1.7, 37, 38, 38.1, 39, 206/39.1, 39.4, 39.5, 45.28, 63.5, 83, 204, 206/205, 209, 213.1, 214, 215, 216, 217, 206/219, 222, 223, 229, 232, 233, 242, 206/246, 256, 259, 265, 268, 271, 273, 206/278, 292, 308.1, 311, 312, 315.9, 206/316.1, 316.2, 363, 364, 366, 369, 206/370, 372, 373, 382, 383, 386, 387.1, 206/388, 390, 408, 424, 438, 440, 441, 206/443, 445, 447, 449, 455, 457, 459.1, 206/459.5, 461, 462, 469, 470, 471, 481, 206/484, 489, 493, 494, 495, 499, 503, 206/504, 508, 518, 521, 521.2, 522, 523, 206/524.3, 524.6, 525, 526, 528, 529, 206/530, 531, 532, 534, 538, 542, 555, 206/557, 558, 560, 563, 564, 569, 570, 206/571, 572, 575, 579, 581, 585, 591, 206/592, 594, 596, 701, 736, 768, 778, 206/806, 811, 812, 813, 815, 820, 823, 206/824; 220/1.5, 1.6, 3.3, 3.8, 4.01, 220/4.27, 4.28, 9.1, 9.2, 9.3, 9.4, 23.87, 220/62.12, 62.15, 62.17, 62.2, 86.2, 87.1, 220/89.2, 89.3, 200, 202, 203.08, 211, 220/212, 212.5, 215, 216, 220, 227, 229, 220/230, 241, 252, 253, 254.1, 254.3, 220/254.5, 254.6, 254.7, 255, 255.1, 220/256.1, 257.2, 258.1, 258.2, 258.3, 220/259.1, 259.2, 259.5, 260, 262, 263, 220/264, 265, 266, 267, 268, 269, 270, 220/276, 277, 280, 281, 287, 289, 293, 220/295, 297, 300, 303, 304, 309.1, 315, 220/322, 323, 324, 345.1, 345.2, 345.4, 220/350, 359.1, 359.2, 359.4, 361, 368, 220/371, 375, 378, 379, 476, 477, 480, 220/481, 482, 484, 495, 495.02, 495.04, 220/495.07, 495.08, 500, 501, 503, 507, 220/521, 522, 523, 524, 526, 530, 567.1, 220/567.2, 573.1, 574, 578, 592.01, 220/592.03, 592.17, 592.2, 592.24, 600, 220/615, 617, 641, 646, 666, 668, 669, 220/679, 694, 694.1, 703, 709, 710, 220/710.5, 713, 715, 717, 720, 721, 730, 220/735, 737, 739, 770, 772, 776, 780, 220/785, 788, 791, 796, 810, 812, 813, 220/818, 826, 827, 830, 832, 833, 834, 220/835, 836, 837, 838, 841, 845, 849, 220/903, 908, 908.2, 912, 915.2, 916, 220/2.1 A, 2.1 R, DIG. 29, DIG. 33, 220/DIG. 9; 221/1, 2, 3, 25, 26, 30, 33, 221/34, 35, 36, 37, 39, 40, 43, 45, 46, 47, 221/48, 49, 50, 51, 52, 55, 60, 63, 64, 69, 221/71, 72, 92, 93, 94, 96, 102, 104, 123, 221/135, 151, 152, 155, 185, 197, 198, 221/210, 213, 227, 232, 236, 239, 249, 221/251, 259, 261, 268, 279, 281, 286, 221/287, 303, 305, 307, 309, 150 A, 221/150 HC, 150 R; 224/148.7, 153, 154, 224/156, 160, 164, 171, 184, 191, 193, 224/194, 218, 242, 243, 250, 251, 259, 224/269, 275, 312, 324, 328, 404, 406, 224/413, 502, 521, 532, 536, 544, 550, 224/554, 571, 576, 579, 587, 600, 610, 224/637, 645, 650, 666, 676, 909, 911, 224/917.5, 924; 229/4.5, 5.5, 5.7, 5.81, 229/5.84, 69, 71, 72, 76, 77, 79, 87.05, 229/87.06, 87.07, 87.08, 87.17, 92, 92.1, 229/92.3, 92.8, 101, 108, 112, 117.14, 229/119, 120, 120.11, 120.18, 120.25, 229/120.32, 120.36, 120.37, 122, 122.32, 229/122.34, 123, 123.1, 123.2, 125,

229/125.015, 125.11, 125.16, 125.19, 229/125.32, 125.35, 130, 145, 149, 155, 229/160.1, 160.2, 162.3, 162.6, 162.7, 229/164, 169, 198.2, 199, 211, 223, 227, 229/232, 235, 245, 300, 301, 303, 304, 229/305, 400, 403, 902, 903, 904, 905, 229/906; 242/534, 563; 271/3.05, 3.11, 271/3.13, 3.14, 3.21, 4.01, 4.04, 4.1, 5, 271/9.01, 9.02, 9.05, 9.08, 9.11, 9.12, 271/9.13, 10.01, 10.03, 10.04, 10.06, 271/10.09, 10.11, 10.12, 11, 12, 13, 14, 271/17, 18, 18.1, 18.2, 18.3, 19, 20, 21, 271/22, 25, 30.1, 31, 31.1, 33, 34, 35, 37, 271/38, 42, 90, 91, 93, 94, 95, 97, 98, 99, 271/101, 103, 104, 105, 106, 107, 108, 271/109, 110, 113, 114, 115, 117, 118, 271/119, 120, 121, 122, 123, 124, 125, 271/127, 128, 130, 145, 146, 148, 149, 271/151, 152, 153, 155, 156, 158, 160, 271/161, 162, 164, 167, 171, 186, 193; 426/3, 68, 72, 73, 74, 77, 78, 85, 86, 87, 426/96, 106, 107, 111, 112, 115, 119, 426/120, 122, 123, 124, 128, 129, 234, 426/243, 285, 297, 388, 389, 410, 411, 426/412, 420, 425, 431, 453, 489, 502, 426/503, 504, 510, 512, 515, 517, 524, 426/549, 554, 555, 560, 573, 577, 582, 426/584, 589, 595, 611, 622, 629, 637, 426/650, 656, 658, 661, 808; 429/9, 10; 600/37, 121, 123, 129, 153, 300, 309, 600/310, 317, 372, 373, 374, 375, 377, 600/393, 397, 509; 602/41, 42, 43, 45, 602/46, 47, 52, 57, 58, 59, 60, 75, 900; 604/15, 57, 59, 60, 187, 218, 279, 285, 604/288, 904; D9/433, 438, 654, 748; 222/1, 82, 83, 94, 105, 129, 137, 143, 222/146.1, 146.2, 153.13, 156, 158, 167, 222/180, 183, 189.01, 189.06, 190, 199, 222/206, 209, 212, 215, 233, 252, 309, 222/318, 325, 326, 330, 334, 375, 401, 222/402, 410, 415, 450, 454, 456, 490, 222/494, 501, 507, 511, 512, 517, 520, 222/541.1, 546, 548, 556, 558, 559, 561, 222/562, 633, DIG. 1; 428/1.1, 1.2, 1.25, 428/1.5, 2, 12, 13, 33, 34, 34.1, 34.2, 428/34.8, 35.4, 35.5, 35.7, 35.8, 36.6, 428/36.8, 36.92, 39, 40.1, 40.2, 40.9, 428/41.3, 41.5, 41.6, 41.7, 41.8, 41.9, 428/42.1, 42.2, 42.3, 43, 67, 71, 74, 77, 428/81, 85, 90, 91, 94, 100, 113, 114, 428/120, 121, 137, 138, 156, 159, 172, 428/178, 187, 192, 194, 195.1, 198, 201, 428/202, 203, 204, 210, 212, 214, 215, 428/216, 218, 299.4, 300.7, 304.4, 317.1, 428/317.9, 319.1, 319.3, 332, 339, 343, 428/349, 352, 354, 365, 401, 402, 408, 428/411.1, 412, 413, 416, 421, 423.1, 428/424.6, 424.8, 425.1, 426, 432, 457, 428/458, 460, 461, 474.4, 479.6, 480, 428/500, 507, 511, 513, 514, 518, 520, 428/522, 523, 537.1, 542.6, 610, 615, 428/620, 641, 698, 702, 903.3, 905, 906, 428/912.2, 913, 913.3, 914, 916, 355 EN, 428/355 N, 355 R; 492/9, 10

See application file for complete search history.

(56) References Cited

U.S. PATENT DOCUMENTS

| | | | | |
|---|---|---|---|---|
| 2005/0067313 | A1 | 3/2005 | Banik | |
| 2008/0110918 | A1 | 5/2008 | Lee | |
| 2009/0200331 | A1* | 8/2009 | Bunoz | A47K 10/3818 221/45 |
| 2010/0032445 | A1 | 2/2010 | Bunoz | |

FOREIGN PATENT DOCUMENTS

| | | | | |
|---|---|---|---|---|
| CN | 204453486 | U | 7/2015 | |
| CN | 108177902 | A | 6/2018 | |
| DE | 9317973 | U1 * | 6/1994 | B65D 75/5877 |
| DE | 9317973 | U1 | 6/1994 | |
| DE | 202014102636 | U1 * | 6/2014 | B65D 83/08 |
| DE | 202014102636 | U1 | 6/2014 | |
| EP | 0331027 | A1 | 9/1989 | |
| RU | 2252181 | C2 | 5/2005 | |
| RU | 2627208 | C2 | 8/2017 | |
| WO | WO 96/37139 | A1 | 11/1996 | |

* cited by examiner

SHEET PRODUCT DISPENSER AND PACKAGING UNIT THEREFOR

CROSS-REFERENCE TO PRIOR APPLICATIONS

This application is a U.S. National Phase application under 35 U.S.C. § 371 of International Application No. PCT/EP2020/056894, filed on Mar. 13, 2020, and claims benefit to European Patent Application No. EP 19165824.4, filed on Mar. 28, 2019. The International Application was published in German on Oct. 1, 2020 as WO 2020/193232 under PCT Article 21(2).

FIELD

The invention relates to a sheet product dispenser and a packaging unit therefor. The sheet product dispenser comprises a housing and the packaging unit, the packaging unit being arranged in the housing, the packaging unit comprising a roll of sheet products, which can be detached from the roll, and a liquid-tight bag, in which the roll is arranged, and the bag having a removal opening for removal of the sheet products.

BACKGROUND

Such a sheet product dispenser is known from DE 20 2014 102 636 U1.

The sheet products are designed as moist sheet products and arranged in the bag. The bag is provided with a first intake opening, which is surrounded by a flange and forms a unit that can be assembled therewith. The housing has a second removal opening essentially corresponding to the first removal opening and a closure cover serving to close the second removal opening. The flange is non-destructively and releasably connected to the housing.

The bag of the previously known sheet product dispenser is made, for example, of a flexible material, which is selected such that it can be easily connected to the flange surrounding the removal opening. For example, the bag can be made of a thermoplastic material.

The sheet products can be made of natural or synthetic fibers and are preferably made of a textile fabric, a foam or a nonwoven.

SUMMARY

In an embodiment, the present invention provides a sheet product dispenser that includes a housing and a packaging unit arranged in the housing. The packaging unit includes a roll of sheet products and a liquid-tight bag in which the roll is arranged. The liquid-tight bag includes a removal opening for removal of the sheet products, the removal opening being delimited by a dimensionally stable coupling ring made of a tough material. The dimensionally stable coupling ring is connected to an annular feeder encompassing a feeder opening, and the housing and the annular feeder are non-destructively and releasably connected to one another.

The object of the invention is to further develop a sheet product dispenser of the type mentioned at the outset in such a way that it can be produced simply and cost-effectively and can be easily handled by the user. The risk of soiling or contamination of the sheet products in the sheet product dispenser, or during their removal from the sheet product dispenser, should especially be reduced to a minimum, and the sheet product dispenser should consequently thus meet especially high hygiene requirements. The sheet products that have not yet been detached from the roll should be storable in the sheet product dispenser in a hygienically clean manner, without coming into contact with the environment.

This object is achieved according to the invention by a sheet product dispenser according to claim 1 and a packaging unit according to claim 24. The claims referring back directly or indirectly thereto refer to advantageous embodiments.

BRIEF DESCRIPTION OF THE DRAWINGS

The embodiments of the present disclosure will be described in even greater detail below based on the exemplary figures. The embodiments are not limited to the exemplary embodiments shown herein. Other features and advantages of various embodiments of the present disclosure will become apparent by reading the following detailed description with reference to the attached drawings which illustrate the following.

DETAILED DESCRIPTION

Figure 1:
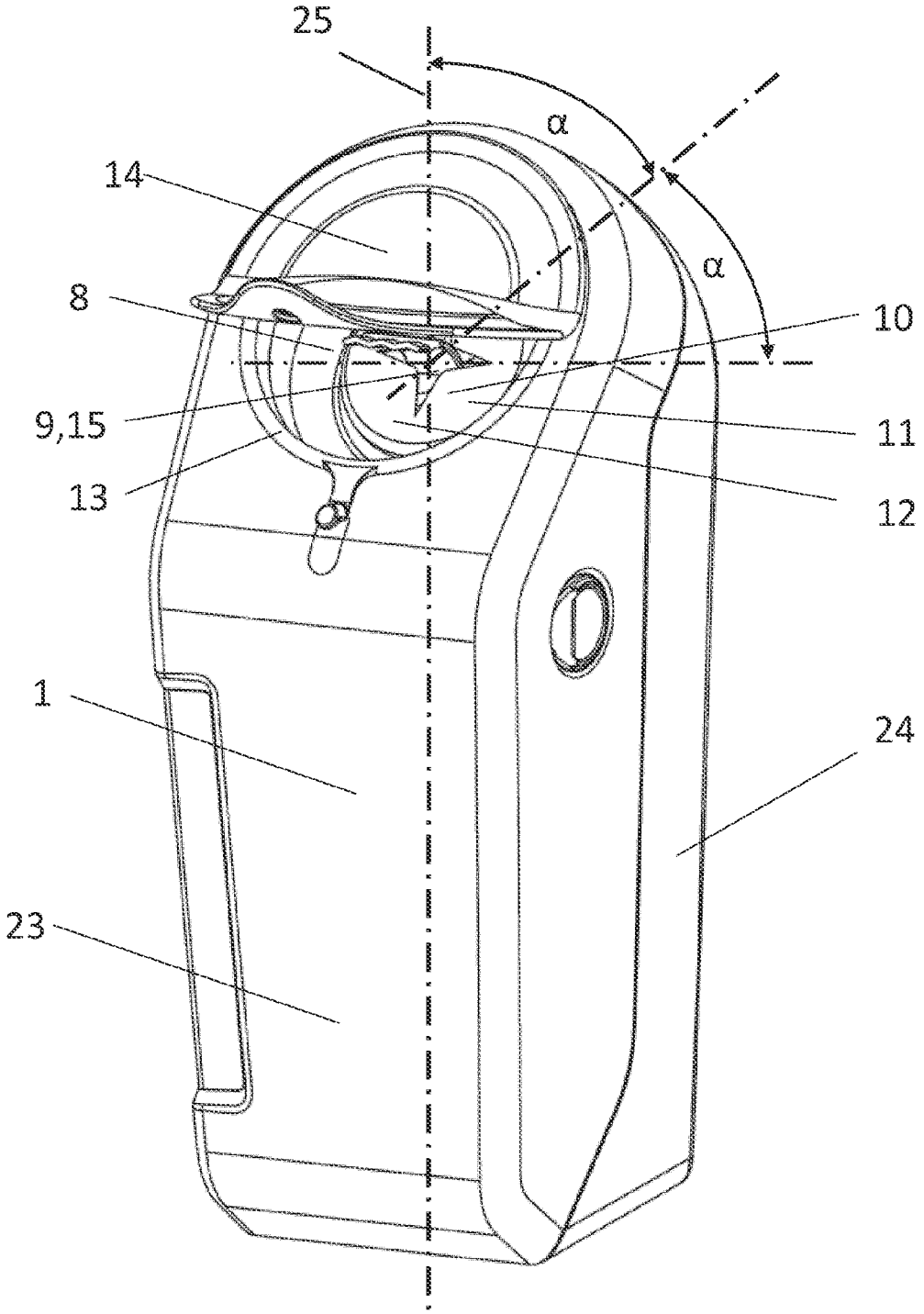
FIG. 1 shows a sheet product dispenser in the ready-to-use state, vertically standing.

To achieve the object, a sheet product dispenser is provided, comprising a housing and a packaging unit, the packaging unit being arranged in the housing, the packaging unit comprising a roll of sheet products, which can be detached from the roll, and a liquid-tight bag, in which the roll is arranged, the bag having a removal opening for removal of the sheet products, the removal opening being delimited by a dimensionally stable coupling ring made of a tough material, the coupling ring being connected to an annular feeder encompassing a feeder opening, and the housing and the feeder being designed in two parts and being non-destructively and releasably connected to each other.

The aforementioned sheet product dispenser has many advantages.

Given that the housing and the feeder have a two-part design and are non-destructively and releasably connected to one another, it is possible to design the feeder, especially its feeder opening, depending on the respective circumstances of the application. The shape of the feeder opening can, for example, be adapted to the nature of the respective sheet products in the bag. If thicker or thinner sheet products, or sheet products that are more or less strongly, or heavily, soaked with cleaning and/or disinfecting liquid, are used, the feeder can be adapted to the housing due to its two-part design. The sheet product dispenser practically has a modular design. Due to its two-part design for the housing, the feeder can also be removed from the housing as needed and cleaned/disinfected or replaced separately. This is especially advantageous in order to be able to meet especially high hygiene requirements. With such an embodiment, it is also advantageous that the housing and the feeder can, following their respective use, be recycled.

The coupling ring is connected to the housing of the sheet product dispenser by means of the feeder. The feeder and the coupling ring are preferably connected to each other in a sealing manner. The path of the sheet products from the roll through the inside of the bag to the removal opening, through the removal opening, through the coupling ring and the feeder into the environment is thus safe against exposure to contaminants. The sheet products are hygienic until removed from the sheet product dispenser.

The housing can be made of a dimensionally stable material. Such a housing is advantageous, because the bag inside the housing is thereby well protected from external influences. The bag is protected by the housing not only from undesired exposure to moisture and/or contaminants from the environment. Undesired mechanical influences on the bag, for example, pressure loads, which could lead to damage to the bag and consequently to contamination of the sheet products with impurities, are also absorbed by the housing and thereby securely kept away from the bag.

In addition, such a housing can be mounted so as to be suspended on a wall or another device (e.g., a cleaning cart), as a result of which sheet products can be given from the roll in an ergonomically favorable position.

In a further embodiment, the shell of the housing facing the user can be designed to be transparent. As a result, it is possible to distinguish sheet products with a color coding (for different fields of application or with different cleaning chemicals used) from the outside, without the housing having to be opened or otherwise made distinguishable as by a separate color marking.

The feeder can also be made of a dimensionally stable material. As a result, it also contributes to protecting the bag from the aforementioned undesired external influences.

The respective dimensionally stable material can in each case be made of a polymeric material. Polymeric materials are available cost-effectively in many specifications and can be processed easily and reliably for the production of housing and feeder. The polymeric materials are corrosion-resistant, lightweight and resistant to cleaning and/or disinfecting liquids, with which the sheet products are soaked, for example.

The respective dimensionally stable material can in each case be made of a metallic material. The feeder could especially be a deep-drawing punch part made of stainless steel, which in turn enables hygienic processing, for example by autoclaving.

The feeder can be connected to the housing in a force-fitting and/or positive-locking manner. The feeder and the housing are connected to one another in a sealed manner in order to prevent contamination of the interior of the housing during use of the sheet product dispenser.

A force-fitting connection can be achieved, for example, by clamping the feeder and the housing together.

A positive-locking connection is provided when the feeder and the housing are connected to one another, for example, by a latching connection or a bayonet closure or by a screwed or clamping joint.

According to an advantageous embodiment, it can be provided that the feeder can be arranged at a 45° angle in the housing in relation to a vertically standing or horizontally lying housing. The 45° angle also relates to the longitudinal axis of the housing or to the longitudinal axis of the roll. Such a sheet product dispenser is especially universally usable. It does not matter in terms of handling by the user whether the sheet product dispenser is used while suspended from a wall or lying on a work surface. The handling in both described positions does not differ.

The feeder can have an essentially pot-shaped design with a bottom that has the feeder opening and a first edge that is arranged on the side of the bottom that faces away from the packaging unit and surrounds the bottom on the outer circumference, the bottom and the first edge delimiting an interior of the feeder. After a sheet product is separated, the end of the subsequent sheet product that is then still connected to the roll can be accommodated in this interior space of the feeder. The interior is in any case large enough for this purpose. The end is arranged completely within the interior. A sagging of the end out of the interior space into the environment and thus a contamination with harmful environmental influences can be avoided if the interior space is covered by a closure cover, as explained below.

The first edge of the feeder may be surrounded on the outer circumference by a second edge of the housing. The first edge and/or the second edge may be contactable in a sealing manner by a closure cover. Depending on the design of the sheet product dispenser, the closure cover either seals against the first edge of the feeder or against the second edge of the housing.

Sealing of the closure cover on the first edge of the feeder has the advantage that the sheet product and, in the same way, the hand of the user always contact only the coupling ring, feeder and closure cover elements when sheet products are removed. Given that these three elements can be used as disposable elements, a maximally high hygiene standard can thereby be realized within the sheet product dispenser. In the same way, aggressive chemicals, with which the roll can be pre-soaked, do not come into contact with the housing; the durability of the housing elements is maintained, for example.

In contrast, if the closure cover seals on the second edge of the housing, it is advantageous that the feeder can be made simpler, because the surface design and manufacturing tolerances in this case only have to take into account the fitting precision of the positive-locking/force-fitting interface between the feeder and the housing. The functionally more important sealing lines or sealing surfaces and their sealing design between the closure cover and the housing can then be implemented solely in the housing.

The closure cover may be made of a thermoplastic elastomer. Such elastomeric materials are generally known as rubber-elastic sealing materials and are available in a wide variety of specifications.

The closure cover can either be made of a single elastomeric material, that is to say made of a uniform material, with which the closing force results from the inherent elasticity of the flexible cover. The closure cover falls into its original shape on its own and thereby closes the opening.

Or the cover is made of a 2-component material composite, with which the cover structure is made of a dimensionally stable material, while the sealing line(s) or surface(s) on the closure cover are made of an elastic, rubber-like material at the contact points with the first edge of the feeder or the second edge of the housing. In this case, the automatic closing of the closure cover can be accomplished either by, for example, a locking spring or by the closure cover's own weight.

The closure cover can be made of a silicone material. Such a material is advantageous, because it has excellent resistance to most cleaning and/or disinfecting liquids. The usage properties of a closure cover made of silicone are consistently good during a long service life of the sheet product dispenser.

The closure cover is preferably designed to be self-closing. The restoring force of the cover into the closed position is generated either by the cover's own weight and/or by the restoring elasticity inherent in the cover geometry and the cover material.

In this case, it is advantageous that the closure cover automatically moves into the closed position immediately after removal of a sheet product and seals against one of the aforementioned edges. As a result, the removal opening and thus the interior of the bag are exposed to influences from the environment only briefly when a sheet product is removed, so that dirt or germs are kept away from the sheet products still arranged in the roll as much as possible, and in addition, the evaporation of the cleaning solution with which the roll is pre-soaked is reduced or completely prevented.

In addition, it can be provided that the closure cover rests in a sealing manner against one of the edges not only in a self-sealing manner. In addition, the closure cover can preferably be non-destructively and releasably connected to the housing or the feeder in a force-fitting and/or positive-locking manner. As a result, the interior of the sheet product dispenser is hermetically separated from the environment, so that air or liquid, for example liquid arranged in the bag, cannot escape from the interior of the sheet product dispenser into the environment. And not even if the housing is tilted or rotated. The force-fitting and/or positive-locking connection can be achieved by pressing, screwing, clamping, or by one or more additional tabs on the closure cover.

Below, the aforementioned types of compounds will be discussed in more detail, and the respective advantages will be described:

Pressing in:

With this method, which is known, for example, from storage containers in the kitchen area, a rapid and simple closing of the opening is possible, so that an excess of cleaning solution, which has not yet been completely sucked up by the sheet product roll, cannot escape even when the housing is tilted. When pressing in, the user receives a haptic feedback by overcoming the latching resistance that the cover is securely closed. The cover itself can also be designed as a dimensionally stable part without a special sealing lip, because solely the elasticity of the dimensionally stable material in combination with the pre-stressing generated when pressing in ensures a complete sealing.

Screwing:

Screwing allows a simple type of closing that is likewise known from other applications. In combination with a separate sealing lip or, for example, a sealing lip integrally molded in 2-component technology in the injection molding process, the user can adjust the degree of tightness himself by turning the screw connection with more or less force.

Clamping:

In the case of clamping, the closure cover can be connected securely and above all visibly to the housing via separate clamping elements and sealed against it. During an inspection, for example, by a hygiene professional, whether or not the cover is securely sealed by attaching and fixing the clamps can be assessed very easily.

An Additional Tab on the Closure Cover:

A tab on the closure cover supplements the normal positive fit for sealing with a further frictional connection, by the inherent elasticity of the cover being utilized in such a way that, when the tab is fixed to the cover by means of, for example, a push button, said tab is additionally pressed on and fixed.

A Plurality of Additional Tabs on the Closure Cover:

In the case of a plurality of additional tabs, the fixing and sealing of the cover is achieved via a plurality of tabs arranged on the circumference, whereby the contact force is evenly distributed.

In comparison to clamping, tabs on the closure cover have the advantage that they can be made of a uniform material and that parts cannot be lost.

The bottom has a recess designed as a feeder opening for the removal of the sheet products from the housing. In order to remove a sheet product from the sheet product dispenser, the end of the sheet product still connected to the roll and arranged in the interior of the feeder is first gripped by the user after the closure cover is opened. The sheet product is then completely pulled through the feeder opening. In order to separate the sheet product from the subsequent sheet product, which is still joined to the roll, the pulled sheet product is guided in the direction of the edge of the recess. In this case, an end of the subsequent sheet product still connected to the roll is held clamped by the feeder. The sheet product to be detached can then be detached from the subsequent sheet product that is still connected to the roll along a defined perforation line.

Such separation can thereby take place especially easily and reliably if the recess is formed by at least one slot tapering radially outward. The further the sheet products pulled out of the roll are pulled radially outwards into the radially outwardly tapering slot, the more strongly the sheet product jams in the slot and can thereby be easily detached.

The recess can have an essentially star-shaped design. With such a recess, there is no preferred direction in which the sheet product would have to be pulled from the sheet product dispenser and detached from the roll. The sheet product dispenser can thereby be used equally well from different usage directions (from the left, from the right, from the top, from the bottom, from the front) and independently of the spatial orientation of the sheet product dispenser.

It is irrelevant for handling whether the users of the sheet product dispenser are right or left handed and/or whether the sheet products are removed from the sheet product dispenser at the left, right, top or bottom.

The sheet products rolled on the roll can be joined to one another, for example, by a perforation. The perforation is designed in such a way that the sheet products removed from the sheet product dispenser can be easily and reliably detached from the subsequent sheet product, which is still connected to the roll, and no further sheet products are unintentionally pulled from the sheet product dispenser.

The sheet products can be designed as textile sheet products. Textile sheet products are generally known and may, for example, comprise microfibers or be designed as microfiber sheet products. Textile sheet products are well-suited for many cleaning applications.

The sheet products can be unrolled from the center of the roll. This results in short paths when unrolling the sheet products, and the center of the roll is essentially coaxial with the removal opening. Uncoiling the sheet products from the center of the roll functions especially reliably in a direct path, and undesirably premature tearaway of the sheet product, for example, by jamming from the roll during uncoiling, is largely prevented. In addition, largely identical unrolling conditions exist when unrolling the sheet products from the center of the roll, because the sheet products are always pulled along the longitudinal axis of the roll.

The sheet products can be soaked in the bag with cleaning and/or disinfecting liquid. Sheet product dispensers with such sheet products are preferably used for professional cleaning, for example, in public buildings, hospitals or nursing homes. It is important, especially for such applications, that the sheet products used are hygienically pure.

The sheet products are soaked with cleaning and/or disinfecting liquid in that such a liquid is added to roll with sheet products located in the bag. The sheet products rolled up on the roll absorb the cleaning and/or disinfecting liquid into themselves and are subsequently used as moist cleaning sheet products.

In the type of pre-soaking described here, the amount of liquid can be selected such that it exactly corresponds to the suction line of the roll of sheet products, which results in no excess of cleaning solution and the moisture penetration can also reproducibly and homogeneously go through all sheet products.

In another application, the sheet product roll is already pre-soaked at the factory and then hermetically packaged. In this case, the user no longer has to pre-soak the roll, but can access the ready-to-use moist cleaning sheet products.

The bag can be made of a polymeric material and can have a thin, film-like design. The bag is preferably transparent. The material is selected such that it is resistant to cleaning and/or disinfecting liquid located therein. A bag made of a film-like, thin polymeric material has the advantage that the packaging unit comprising the bag, has only a low weight and that one and the same packaging unit can be used, for example, in differently designed housings, because the shape of the bag can adapt to a certain degree to the inner wall of different housings.

The bag can be made especially of a transparent polymeric material. In this case, the user can recognize from the outside the provided color coding of the sheet product rolls (e.g., in the form of continuous printing on the sheet products). This is especially advantageous if the housing shell of the housing facing the user is also made transparent. As a result, the user can recognize which sheet product color is available without opening the housing.

The coupling ring is made of a dimensionally stable material, especially a polymeric material. The dimensional stability of the coupling ring is important in order to be able to connect it quickly and easily to the feeder, which is likewise designed to be dimensionally stable.

The feeder and the coupling ring can be non-destructively and releasably connected to one another in a force-fitting and/or positive-locking manner. For example, it is possible for the feeder and the coupling ring to be connected to each other by a simple clamping connection or by a latching connection or by a bayonet closure.

After consumption of the sheet products, the empty packaging unit together with its coupling ring is detached from the feeder and replaced by a full packaging unit. The coupling ring of the full packaging unit is then connected to the feeder as described above.

The feeder opening is preferably smaller than the diameter of the roll.

Overall, it is advantageous that the diameter of the feeder opening is as small as possible. However, the size of the feeder opening is large enough to allow the sheet products to be removed from the bag without problems. However, the feeder opening is small enough to protect the content of the packaging unit as much as possible from undesired external influences during the removal of the sheet products.

The invention also relates to a packaging unit for a sheet product dispenser as previously described. The packaging unit comprises a roll of sheet products that can be detached from the roll and a liquid-tight bag, in which the roll is arranged, the bag having a removal opening for removal of the sheet products, the removal opening being limited by a dimensionally stable coupling ring made of a tough material that can be connected to an annular feeder of a sheet product dispenser. The packaging unit is designed as a refill and can easily replace an empty packaging unit, especially because of the dimensionally stable coupling ring.

The removal opening is preferably closed in an airtight and liquid-tight manner by a tearaway closure seal. As a result, the packaging unit can also be stored over a longer period of time, without the negative influences on the quality of the sheet products arranged in the bag, especially those influences that reduce useful life.

The closure seal may be surrounded by a predetermined breaking point. In this case, it is advantageous that the packaging unit, and thus the entire sheet product dispenser, is also easy to handle by inexperienced users. The predetermined breaking point delimits the tearaway closure seal on the outer circumference, so that an opening of always the same, precisely defined size always occurs when the closure seal is removed.

The closure seal can be torn away without tools and in a non-resealable manner.

Tool-free is advantageous, because the closure seal can thereby always and anywhere be easily detached from the coupling ring by the user.

A non-resealable closure seal is especially important when the sheet product dispenser is used in areas that are hygienically especially sensitive, such as hospitals or nursing homes. This ensures that a packaging unit, once opened, is clearly recognizable and is therefore not inadvertently classified as "unopened".

The closure seal can have an inner side facing the roll and an outer side facing away from the roll, a tearaway tab for the removal of the closure seal from the coupling ring being arranged on the outer side and connected to the closure seal. The tearaway tab can be designed, for example, with coloring and/or have a surface profile to increase the gripping capability.

It is especially advantageous if the packaging unit has a first sheet product that can be detached from the roll with a removal lug. The closure seal can be connected to the removal lug on its inside. For commissioning of the packaging unit, the tearaway tab on the outside of the closure seal is first gripped, and the closure seal is removed from the initially hermetically sealed bag. By virtue of the fact that the closure seal is connected to the removal lug on its inside, during the removal of the closure seal the first sheet product is simultaneously rolled off of the roll, so that it can be guided directly through the removal opening without further handling and supplied for use.

The removal lug can be connected to the inside of the closure seal by adhesive bonding.

The user thus does not have to reach his hand through the removal opening into the open bag, in order to pull the first sheet product out of the roll. For hygienic reasons, this is of great advantage.

EMBODIMENT(S) OF THE INVENTION

Figure 2:
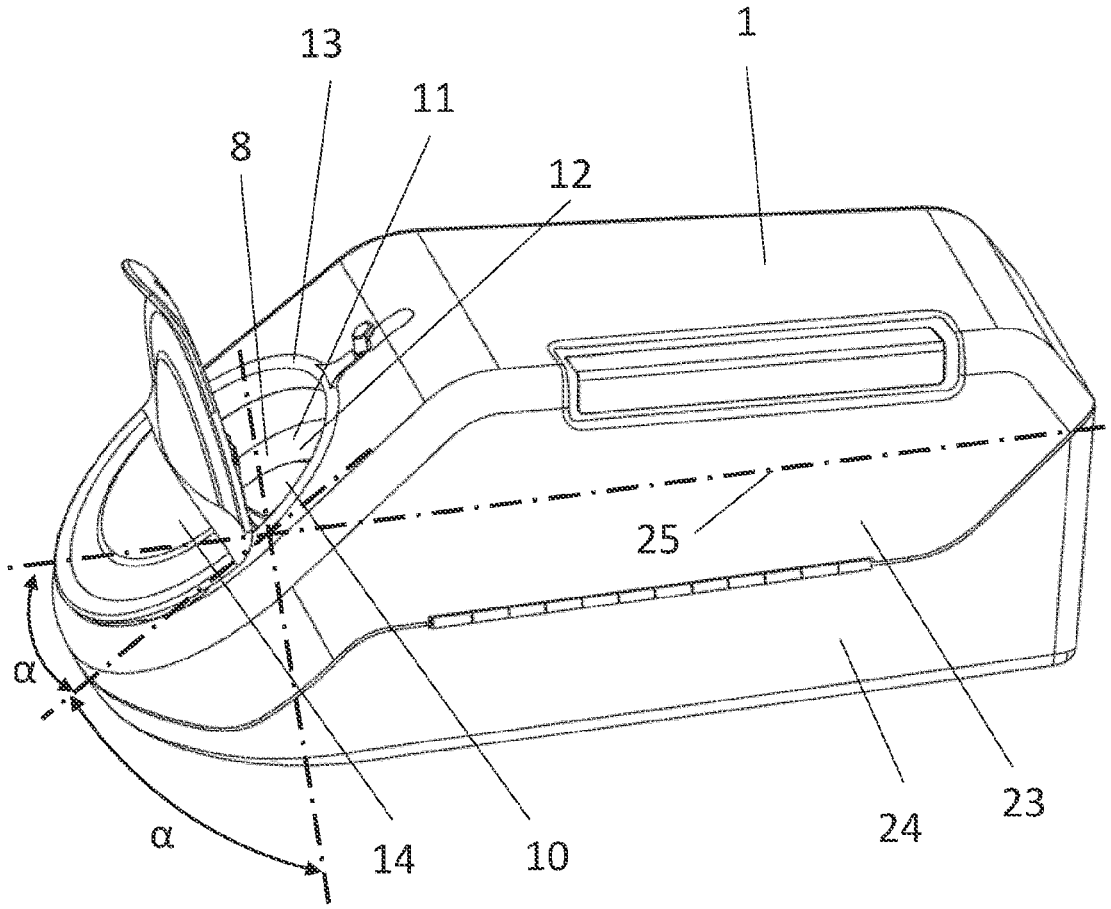
FIG. 2 shows the sheet product dispenser of FIG. 1 lying horizontally.

FIGS. 1 and 2 show an exemplary embodiment of the ready-to-use sheet product dispenser.

In FIG. 1, the sheet product dispenser is shown standing vertically; in FIG. 2, by contrast, the sheet product dispenser is shown lying horizontally.

The feeder 8, which is non-destructively and releasably connected to the housing 1, is arranged at a 45° angle $\alpha$ relative to the vertically standing housing 1 in FIG. 1 and the horizontally lying housing 1 in FIG. 2.

As can be seen, the housing 1 is designed in a plurality of parts. The feeder opening 9 of the feeder 8 is covered by the rubber-elastic closure cover 14.

Figure 3:
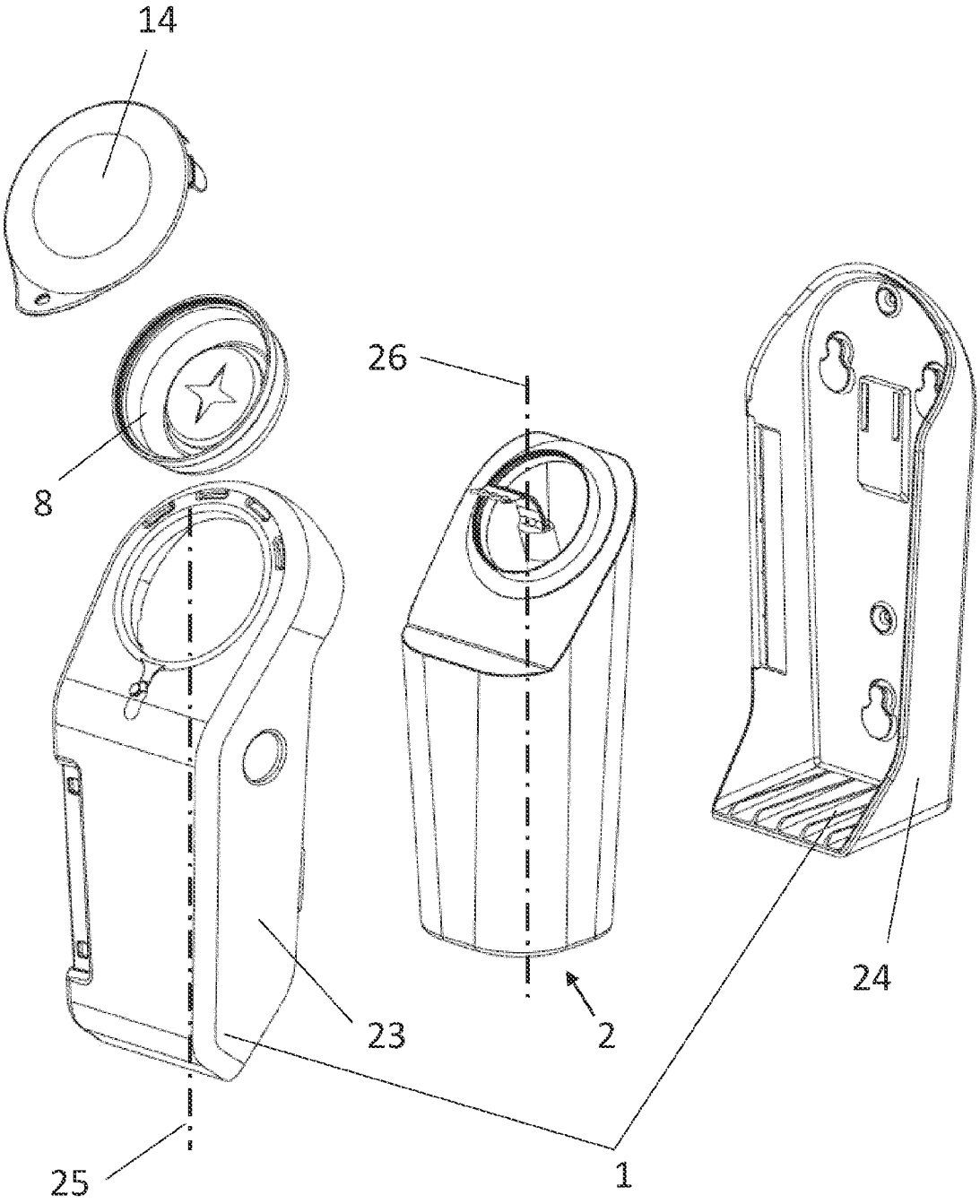
FIG. 3 is an exploded view of the sheet product dispenser shown in FIGS. 1 and 2.

FIG. 3 shows the sheet product dispenser from FIGS. 1 and 2 in an exploded view. The sheet product dispenser comprises the feeder 8 connected to the multi-part housing 1, which comprises two shells 23, 24, which are non-destructively and releasably fixed to one another during the intended use of the sheet product dispenser and enclose the packaging unit 2. These two shells can be connected to one another either via a latching connection or a joint and can be opened for filling with a sheet product roll.

The packaging unit 2 comprises the roll 3 of sheet products 4 that can be detached from the roll 3, adjacent sheet products 4 being connected to one another by a perforation. The roll 3 with the detachable sheet products 4 is arranged in the liquid-tight bag 5, the sheet products 4 in the exemplary embodiment shown here being designed as moist sheet products and being soaked with a cleaning and/or disinfecting liquid.

The bag 5 has the removal opening 6 for the removal of the sheet products 4. The removal opening 6 is delimited by the dimensionally stable coupling ring 7. During the intended use of the sheet product dispenser, the coupling ring 7 is non-destructively and releasably connected to the annular feeder 8, which has a star-shaped recess 15 as feeder opening 9.

In the exemplary embodiment shown, the housing 1, the feeder 8 and the coupling ring 7 are each made of a dimensionally stable, polymeric material. The feeder 8 is designed as a single part and inserted into a congruent recess in the housing 1 in a sealing manner. The feeder 8 is non-destructively and releasably connected to the housing 1 in a force-fitting and/or positive-locking manner.

The feeder 8 has a pot-shaped design. As a result of the pot-shaped embodiment, the feeder 8 has an internal space 12 in which an end of a subsequent sheet product still connected to the roll is arranged during use of the sheet product dispenser according to the invention. In the unused state of the sheet product dispenser, in order to prevent exposure of the end to contaminants from the environment, the feeder 8 is hermetically sealed by the closure cover 14.

The slit-shaped feeder opening 9, in which the slots are arranged in a star shape in the illustration shown, is arranged in the bottom 10 of the feeder 8.

The star-shaped feeder opening 9 is arranged in the bottom 10 of the feeder 8. The first edge 11 is arranged on the side of the bottom 10 facing away from the packaging unit 2 and surrounds the bottom 10 on the outer circumferential side. The bottom 10 and the first edge 11 delimit the interior 12 of the feeder 8.

The sealing contact of the rubber-elastic closure cover 14 takes place either on the first edge 11, which forms a component of the feeder 8, or on the second edge 13, which forms a component of the housing 1.

In any case, the edges 11, 13 have raised, so that the rubber-elastic closure cover 14 can drop reliably in a sealing and self-sealing manner against one of the edges.

A silicone material is especially well-suited for a good sealing function. Silicone is resistant to most cleaning and disinfecting agents and retains its rubber-elastic properties even during a very long service life of the sheet product dispenser.

For cost reasons, a TPE material can also be used for the closure cover 14.

Handling of the sheet product dispenser is facilitated by the closure cover 14 having a self-closing design. A separate manual closing of the closure cover 14 after removal of a sheet product 4 is therefore not necessary. This is advantageous with regard to simple handling and good hygiene.

The bottom 10 of the feeder 8 comprises slots tapering radially outward, which facilitate the tearaway of the sheet products 4 outside the housing 1. First, the outer sheet product 4 is pulled through the feeder opening 9, then pulled into one of the slots tapering radially outward. An end of the subsequent sheet product 4 is then clamped in the feeder 8. The clamping force with which the subsequent sheet product 4 is held in the feeder 8 is stronger than the force required to tear the sheet product 4 to be used next away from the subsequent sheet product along a perforation.

Figure 4:
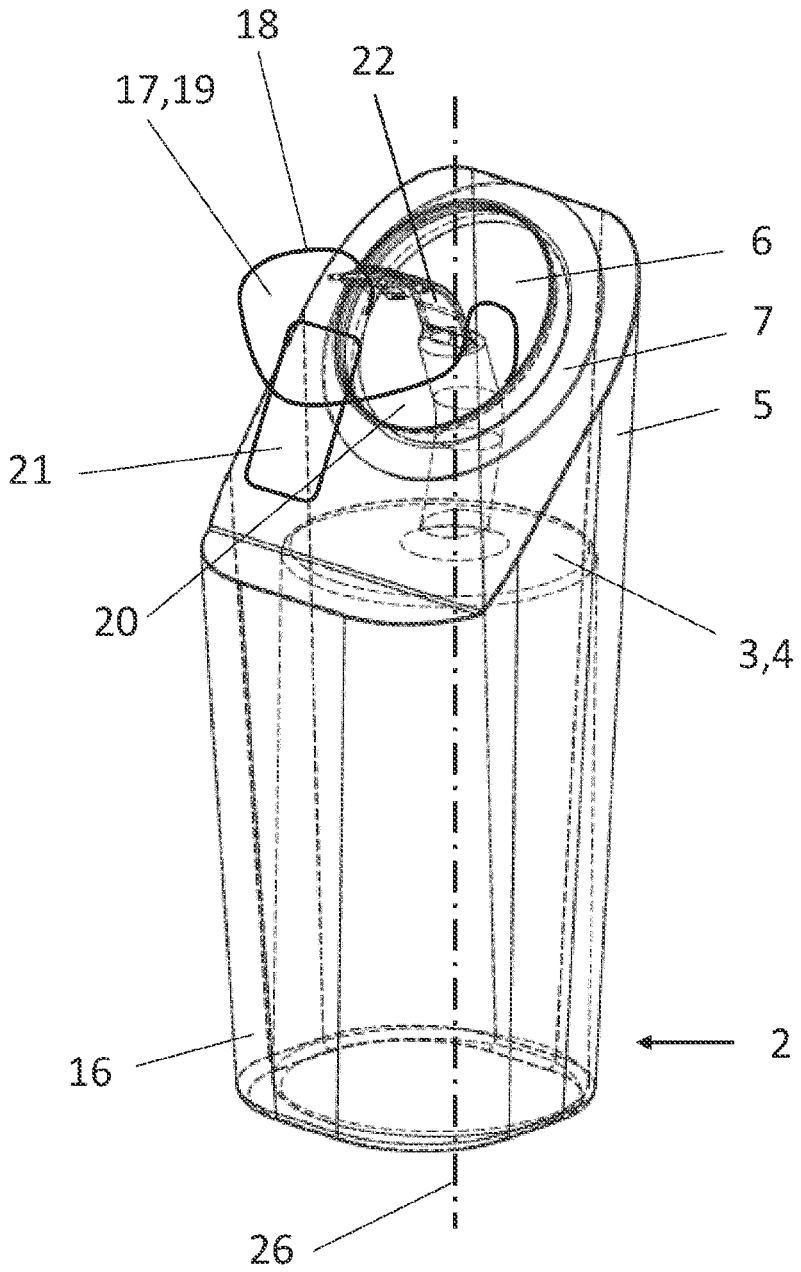
FIG. 4 shows an exemplary embodiment of the packaging unit as used in the sheet product dispenser from FIGS. 1 and 2.

FIG. 4 shows the packaging unit from FIG. 3 as a single part. As already described above, the packaging unit 2 comprises the roll 3 and sheet products 4, which can be detached from the roll 3 and are soaked with a cleaning and/or disinfecting liquid. The roll 3 is arranged in the bag 5, which has the removal opening 6 for the removal of the sheet products 4 that is surrounded by the dimensionally stable coupling ring 7. In the assembled state of the sheet product dispenser, this coupling ring 7 is non-destructively and releasably connected to the annular feeder 8.

The sheet products 4 shown here comprise microfibers and can be unrolled from the center of the roll 3.

The bag 5 is made of a polymeric, film-like thin material. The removal opening 6 is sealed in an airtight and liquid-tight manner by a tear-away closure seal 17.

In the exemplary embodiment shown, the seal 12 is made of the same material as the bag 5 and is surrounded by a predetermined breaking point 18. To remove the closure seal 17, the user grips the tear-away tab 21, which is arranged on the outside 20 of the closure seal 17 and is connected to the closure seal 17. The closure seal 17 separates along the predetermined breaking point 18 when pulled out by the tear-away tab 21, thereby exposing the removal opening 6 surrounded by the coupling ring 7.

It has proven to be especially hygienic and especially convenient and easy to handle for the first sheet product 4, which can be detached from the roll 3, to be connected to the removal lug 22. The removal lug 22 is also connected to the inside 19 of the closure seal 17.

The user of the sheet product dispenser does not have to reach through the removal opening 6 into the interior of the bag 5 in order to unroll the first sheet product 4 from the roll 3. As a result of the removal lug 22 being attached to the inner side 19 of the closure seal 17, the removal lug 22 and the first sheet product 4 connected to the removal lug 22 are automatically entrained when the closure seal 17 is torn away. The removal lug 22 together with the first sheet product 4 is then pulled freely past the closure cover 14 through the feeder opening 9 of the feeder 8.

While the embodiments of the disclosure have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present disclosure covers further embodiments with any combination of features from different embodiments described above and below. Additionally, statements made herein characterizing the embodiments refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A sheet product dispenser comprising:

a housing;

a packaging unit arranged in the housing and comprising a roll of sheet products and a liquid-tight bag in which the roll is arranged, the liquid-tight bag having a removal opening for removal of the sheet products, the removal opening being delimited by a dimensionally stable coupling ring made of a tough material, the dimensionally stable coupling ring being connected to an annular feeder encompassing a feeder opening; and a closure cover comprising a flexible material, the closure cover being configured to contact the annular feeder and/or the housing in a sealing manner in a closed position and further configured to be self-closing into the closed position, wherein the housing and the annular feeder are non-destructively and releasably connected to one another.

2. The sheet product dispenser according to claim 1, wherein the housing is made of a dimensionally stable material.

3. The sheet product dispenser according to claim 1, wherein the feeder is made of a dimensionally stable material.

4. The sheet product dispenser according to claim 1, wherein at least one of the housing or the feeder the is made of a dimensionally stable, polymeric material.

5. The sheet product dispenser according to claim 1, wherein the annular feeder is connected to the housing in a force-fitting and/or a positive-locking manner.

6. The sheet product dispenser according to claim 1, wherein the feeder is arranged within the housing at a 45° angle ($\alpha$) in relation to the housing being arranged in a vertically standing or a horizontally lying manner.

7. The sheet product dispenser according to claim 1, wherein the annular feeder has an essentially pot-shaped design with a bottom and a first edge, wherein the bottom includes the feeder opening and wherein the first edge is arranged on a side of the bottom facing away from the packaging unit and surrounds the bottom on an outer circumference, and in that the bottom and the first edge delimit an internal space of the annular feeder.

8. The sheet product dispenser according to claim 7, wherein the first edge is surrounded on the outer circumference by a second edge of the housing.

9. The sheet product dispenser according to claim 8, wherein the first edge and/or the second edge is contacted in a sealing manner by the closure cover in a sealed configuration.

10. The sheet product dispenser according to claim 9, wherein the closure cover is made of a thermoplastic elastomer (TPE).

11. The sheet product dispenser according to claim 9, wherein the closure cover is made of a silicon material.

12. The sheet product dispenser according to claim 7, wherein the bottom includes a recess that provides the feeder opening for a removal of the sheet products from the housing.

13. The sheet product dispenser according to claim 12, wherein the recess is formed by at least one radially outwardly tapered slot.

14. The sheet product dispenser according to claim 13, wherein the recess has an essentially star-shaped design.

15. The sheet product dispenser according to claim 1, wherein the sheet products are textile sheet products.

16. The sheet product dispenser according to claim 1, wherein the sheet products can be unrolled from a center of the roll.

17. The sheet product dispenser according to claim 1, wherein the sheet products are soaked with a cleaning and/or disinfecting liquid located in the bag.

18. The sheet product dispenser according to claim 17, wherein the bag is made of a polymeric material.

19. The sheet product dispenser according to claim 1, wherein the coupling ring is made of a dimensionally stable material.

20. The sheet product dispenser according to claim 19, wherein the coupling ring is made of a polymeric material.

21. The sheet product dispenser according to claim 1, wherein the annular feeder and the coupling ring are non-destructively and releasably connected to one another in a force-fitting and/or positive-locking manner.

22. The sheet product dispenser according to claim 1, wherein the feeder opening is smaller than a diameter of the roll.

23. A packaging unit for a sheet product dispenser, comprising a roll of sheet products, which can be detached from the roll, and a liquid-tight bag in which the roll is arranged, wherein the bag has a removal opening for removal of the sheet products, and wherein the removal opening is delimited by a dimensionally stable coupling ring made of a tough material that is configured to be connected to an annular feeder of a sheet product dispenser, wherein a first sheet product, which can be detached from the roll, is connected to a removal lug.

24. The packaging unit according to claim 23, wherein the removal opening is sealed in an airtight and liquid-tight manner by a tearaway closure seal.

25. The packaging unit according to claim 24, wherein the closure seal is surrounded by a predetermined breaking point.

26. The packaging unit according to claim 25, wherein the closure seal can be torn away without tools and is not resealable.

27. The packaging unit according to claim 26, wherein the closure seal has an inner side facing the roll and an outer side facing away from the roll, and wherein a tearaway tab for removal of the closure seal from the coupling ring is arranged on the outer side and is connected to the closure seal.

28. The packaging unit according to claim 23, wherein the closure seal is connected on its inside to the removal lug.

* * * * *